US006655389B2

(12) United States Patent
Bertucci

(10) Patent No.: US 6,655,389 B2
(45) Date of Patent: Dec. 2, 2003

(54) HAIR STYLING DEVICE AND METHOD

(76) Inventor: Paul Bertucci, 349-369B Third St., San Rafael, CA (US) 94901

( * ) Notice: Subject to any disclaimer, the term of this patent is extended or adjusted under 35 U.S.C. 154(b) by 0 days.

(21) Appl. No.: 10/027,517

(22) Filed: Dec. 20, 2001

(65) Prior Publication Data

US 2003/0116172 A1 Jun. 26, 2003

(51) Int. Cl.[7] ..... A45D 24/36
(52) U.S. Cl. ..... 132/214
(58) Field of Search ..... 132/213, 213.1, 132/214, 215, 223; 30/200; D28/44, 52, 54

(56) References Cited

U.S. PATENT DOCUMENTS

| | | | | | |
|---|---|---|---|---|---|
| 1,108,224 | A | * | 8/1914 | Perlin | 132/213.1 |
| 2,126,253 | A | * | 8/1938 | Goldberg | 132/223 |
| 2,687,134 | A | * | 8/1954 | Bauer | 132/213.1 |
| 2,722,940 | A | * | 11/1955 | Bohannon | 132/213 |
| 3,115,143 | A | * | 12/1963 | Queen | 30/200 |
| 4,000,562 | A | * | 1/1977 | Alevras | 132/213 |
| 4,003,390 | A | | 1/1977 | Solie | |
| 4,381,015 | A | * | 4/1983 | Harvath | 132/214 |
| 4,381,051 | A | | 4/1983 | Kikuchi | |
| 4,619,044 | A | * | 10/1986 | Dennis | 132/213 |
| 4,926,891 | A | | 5/1990 | Fani et al. | |
| 4,928,716 | A | | 5/1990 | Greene | |
| 5,349,971 | A | | 9/1994 | Player | |
| 5,865,191 | A | | 2/1999 | Kimeta | |
| 5,875,790 | A | | 3/1999 | Morrison | |
| 5,921,240 | A | | 7/1999 | Gall | |
| 5,927,297 | A | | 7/1999 | Cooper | |
| 5,931,164 | A | | 8/1999 | Kiely et al. | |
| 5,937,868 | A | | 8/1999 | Ogunro | |
| 5,947,918 | A | | 9/1999 | Jones et al. | |
| 5,954,063 | A | | 9/1999 | Pomaro | |
| 5,991,918 | A | | 11/1999 | Choate | |
| 5,996,592 | A | | 12/1999 | Choy | |

* cited by examiner

*Primary Examiner*—Todd E. Manahan
(74) *Attorney, Agent, or Firm*—Coudert Brothers LLP

(57) ABSTRACT

A device for styling hair comprising a pair of side walls, a top support member connected to the side walls, a bottom support member connected to the pair of side walls. The device also includes an intermediate support member connected to the pair of side walls between the top support member and the bottom support member to form an upper opening between the top support member and the intermediate support member and to form a lower opening between the bottom support member and the intermediate support member. A method for styling a goatee comprising providing a device having an upper opening and lower opening, positioning lips in the upper opening and a chin including a goatee in the lower opening, and trimming an area around the goatee as desired.

10 Claims, 3 Drawing Sheets

34
36
32
38
50
10
14
12
54
60
18
21
20
38a
38
38c
38d
38b
24
60
18
28b
28

34
38c
38
A
70
70a
24
60
11
28a
28
51
91
20
15
B
13

HAIR STYLING DEVICE AND METHOD

BACKGROUND OF THE INVENTION

1. Field of the Invention

This invention pertains to a hair styling device and method. More specifically, the present invention provides for a hair styling device adapted for placement on the chin of a person for assisting in the accurate styling of hair (e.g. a goatee) on the chin.

2. Description of the Prior Art

A patentability investigation was conducted and the following U.S. patents were discovered: U.S. Pat. No. 4,003,390 to Solie; U.S. Pat. No. 4,381,051 to Kikuchi; U.S. Pat. No. 4,926,891 to Fani et al.; U.S. Pat. No. 4,928,716 to Greene; U.S. Pat. No. 5,349,971 to Player; U.S. Pat. No. 5,865,191 to Kimeta; U.S. Pat. No. 5,875,790 to Morrison; U.S. Pat. No. 5,921,240 to Gall; U.S. Pat. No. 5,927,297 to Cooper; U.S. Pat. No. 5,931,164 to Kiely et al.; U.S. Pat. No. 5,937,868 to Ogunro; U.S. Pat. No. 5,947,918 to Jones et al.; U.S. Pat. No. 5,954,063 to Pomaro; U.S. Pat. No. 5,991,918 to Choate; and U.S. Pat. No. 5,996,592 to Choy.

U.S. Pat. No. 4,003,390 to Solie disclosures an apertured guide for electric razors. The guide is removably engaged the head of an electric razor, and extends therefrom to maintain a predetermined distance between razor blades and surface over which the razor is moved for cutting hair at a predetermined length. The guide is adapted for use in multiple to provide different predetermined separations of razor blades and surface and guide elements thereof are formed with inclined surfaces for trimming hair.

U.S. Pat. No. 4,381,051 to Kikuchi discloses a temperature-sensitive fluid coupler for suppressing noise. A fluid is filled in a space between a cover and an outer casing, to which a plurality of vanes are attached. A partition with two fluid inlet ports is disposed in the space. An inner casing is sandwiched between the partition and the outer casing to form a reservoir between the cover and the partition, an inner torque transmitting chamber between the partition and the inner casing, and an outer torque transmitting chamber between the inner casing and the outer casing. One of the fluid inlet ports of the partition is made to have communication with the inner torque transmitting chambers. The other fluid inlet port of the partition is made to have communication with the outer torque transmitting chamber. The two fluid inlet ports are opened and closed by means of two valves, respectively, which are preset at different temperatures.

U.S. Pat. No. 4,926,891 to Fani et al. discloses a hair cutting guide comprised of a plurality of spaced-apart segments, each of which is formed of a pair of legs having longitudinal axes disposed along intersecting planes such that each segment is generally triangular in cross-section. The guide includes a connecting spine for linking the segments along their top portion to produce a unitary structure having a predetermined height measured from the top surface between the segments along a line perpendicular to a plane defined by the distal ends of the legs in the segments.

U.S. Pat. No. 4,928,716 to Greene discloses a portable hair trimming device for personal grooming operations including a thin triangular housing having a hollow interior portion. An open slotted portion is formed in one side wall of the housing and a trimming implement has one end pivotally mounted adjacent an apex of the housing and is mounted for movement through the open slotted side wall into and out of the hollow interior housing portion. The trimming implement has a first side edge provided with a moustache comb and an opposite side edge provided with a trimming razor. A double-edged razor blade is mounted in a reversible manner in the trimming razor. A cylindrical nose hair trimmer is mounted in a holder on one side wall of the housing. A shallow triangular receptacle having a removable cover is provided on one face of the housing for storing a quantity of moustache wax.

U.S. Pat. No. 5,349,971 to Player discloses a clipper comb for manipulating hair as it is cut with an electric clipper. The clipper comb has a handle and an array of juxtaposed teeth forming a bed. The bed has a clipper bearing surface, a forward segmented guide wall and a rearward guide wall for guiding the electric clipper upon the comb.

U.S. Pat. No. 5,865,191 to Kimeta discloses a hair lifting comb having a plurality of teeth, which are as thick as a bar-shaped supporting member and which at their distal ends are shaped like birds' beaks. The plurality of teeth are attached to the supporting member, as are side members of the comb, each of which is constituted by a first frame member, a second frame member and a third frame member.

U.S. Pat. No. 5,875,790 to Morrison discloses a first comb and a second comb. The first comb has a graduated scale attached near a first end of the scale so that the scale can be pivoted outwardly and inwardly from the first comb. A cutting guide first end is pivotably attached to the second end of the graduated scale. The graduated scale can be slidable lengthwise with respect to the first comb to position the cutting guide a select distance from the first comb. A swivel permits the graduated scale to extend in the plane of the first comb or to extend perpendicular to it or any angle in between. A clamping provision permits the first comb and the graduated scale and the cutting guide to all be fixed in the plane of the first comb, either in a folded carrying configuration or in a ready-to-use configuration. The second comb is pivoted to a first end of the first comb, in essentially the same plane as the first comb, with the teeth of the two combs facing each other. Locking arrangements are provided on the ends of the first and second combs to clamp and hold hair between the combs while cutting the hair using either one of the combs or the cutting guide to support or guide a hair cutting device.

U.S. Pat. No. 5,921,240 to Gall discloses a device for preventing snoring and the grinding of teeth by a user during sleep. The device includes a generally oval plate positioned in the mouth of the user between the teeth and the lips. The oval plate includes an aperture centered therein to accommodate air flow into and out of the mouth. A tab member extends from a first side of the oval plate and through the lips to position the air passage in the flow of air into and out of the mouth when the lips are separated. The device reduces the flow of air into the mouth, thus reducing the vibration of the uvula, which, in turn, reduces the snoring sound.

U.S. Pat. No. 5,927,297 to Cooper discloses a hair restraint system that includes an outer restraint assembly that is connectable to an inner restraint assembly. The outer restraint assembly includes an outer elastic ring layer, an inner tack ring layer formed on an inwardly facing surface of the outer elastic ring layer, and a plurality of spaced female snap halves with the female snap connecting portion oriented toward a ring center of a center ring opening defined by the outer restraint assembly. The inner restraint assembly includes an inner elastic ring that is sized to fit into the center ring opening defined by the outer restraint assembly and having spaced male snap halves each having the male snap connecting portion oriented away from an assembly center opening defined by the inner restraint assembly. The spaced male snap halves of the inner restraint assembly are positionable in registration with and connection to the spaced female snap halves of the outer restraint assembly such that the inner elastic ring covers the inner tack ring layer of the outer restraint assembly.

U.S. Pat. No. 5,931,164 to Kiely et al. discloses a mouthguard including a U-shaped base portion, an upwardly projecting inner flange portion joined to an inner edge of the base portion, and an upwardly projecting outer flange portion joined to an outer edge of the base portion. The upwardly projecting inner flange portion, the upwardly projecting outer flange portion and an upper surface of the base portion form an upwardly facing U-shaped channel. The mouthguard may be molded from a composition including a light pervious foundation material, and a light reflective aggregate distributed throughout the foundation material.

U.S. Pat. No. 5,937,868 to Ogunro discloses an apparatus to separate hair into units of three for braiding, producing several such units in one application. The apparatus comprises a platform having an upper shelf and an anchor. The anchor has comb-like teeth for fixing the device to the hair of the subject. The upper shelf prevents tangling of unbraided hair above the device. A blade, fixed perpendicularly to the platform, has a plurality of teeth separated by notches of alternating depths, which receive strands of hair. A lower shelf affixed at an angle acts as a support for the separated hair strands and prevents tangling. The upper and lower shelves are made removable. The width between braids may be varied by providing teeth of different widths on the upper shelf.

U.S. Pat. No. 5,947,918 to Jones et al. discloses an impact energy absorbing composite material of expanded polytetrafluoroethylene (ePTFE) and an elastomer is disclosed. The composite is comprised of at least one layer of expanded polytetrafluoroethylene and at least one layer of an elastomer. The individual layer thicknesses of the ePTFE and elastomer are controlled to achieve superior high energy impact resistance.

U.S. Pat. No. 5,954,063 to Pomaro discloses a hair cutting and styling device including a semi-rigid inner band member which has a curved generally semi-circular shape and is sized to substantially encircle the head of a user and be retained in place by an elongated strap member attached onto one end of the inner band member. The elongated strap member is formed of a detachable hook and loop fastening material such as VELCRO®, which permits the device to be releasably retained on the head of a person whose hair is being cut and styled.

U.S. Pat. No. 5,991,918 to Choate discloses a barber's guard ring for protecting portions of his hand from scissortip cuts. The ring comprises a band portion which is adapted to be worn on the barber's central finger adjacent the base of that finger and metacarpal body of his hand. The ring also includes at least one protective flange. A first end section of the flange is connected to the band portion. A body section of the flange is connected to the first end section and overlies a portion of the barber's central finger and also a portion of his neighboring finger. And a second end section of the flange is connected to the body section. The second end section has an outside surface which is spaced apart from the metacarpal knuckles of his central finger and the neighboring finger.

U.S. Pat. No. 5,996,592 to Choy discloses a cutting tool including first, second and third pairs of scissors. The first and third pairs of scissors are spaced apart from the second pair of scissors by a fixed distance. Each pair of scissors includes a first elongated member and a second elongated member pivotally coupled to the first elongated member. Each elongated member has a handle portion and a cutting portion, including a cutting blade. The cutting tool further includes spacing elements disposed between each pair of scissors to offset the pairs of scissors from each other. A retaining member is coupled to the first elongated member of each pair of scissors to secure the first elongated members together. The second elongated member of each pair of scissors, however, is movable independent of the other scissors. The cutting tool is ideally suited for cutting and styling hair when dry.

None of the foregoing prior art teaches or suggests a device for assisting in shaping a goatee. Therefore, what is needed and what has been invented is a hair styling device which is particularly suited for forming and maintaining a goatee. What is also needed and what has been invented is a method for forming and/or maintaining the shape of a goatee.

SUMMARY OF THE INVENTION

The present invention provides a device for styling hair comprising a pair of side walls, a top support member connected to the side walls, a bottom support member connected to the side walls. An intermediate support member is connected to the side walls between the top support member and the bottom support member to form an upper opening between the top support member and the intermediate support member and a lower opening between the bottom support member and the intermediate support member.

The bottom support member includes a structure defining an arcuate edge. A lug member is secured to the intermediate support member. The top support member comprises a generally triangular gable member, and a guide roof secure for the gable member. The gable roof comprises a pair of generally trapezoidal shape roof members, each comprising a pair of non-parallel edges terminating in an apex. Each of the side walls comprises an upper side section integrally connected to a lower side section obliquely extending away from the upper side section. The lower side section comprises an upper side edge and a lower side edge tapering towards each other and terminating in the bottom support member. The upper side edge terminates in the arcuate edge of the bottom support member.

The present invention also provides a method for styling a goatee comprising providing a device having an upper opening and a lower opening, positioning lips in the upper opening and a chin with a goatee in the lower opening, and trimming (e.g. with a razor) an area around the goatee such that opposed boundaries of the lower opening provide a width for the goatee.

These provisions together with the various ancillary provisions and features which will become apparent to those skilled in the art as the following description proceeds, are attained by the methods and structures of the present invention, preferred embodiments thereof being shown with reference to the accompanying drawings, by way of example only, wherein:

DESCRIPTION OF PREFERRED EMBODIMENTS OF THE INVENTION

Figure 2:
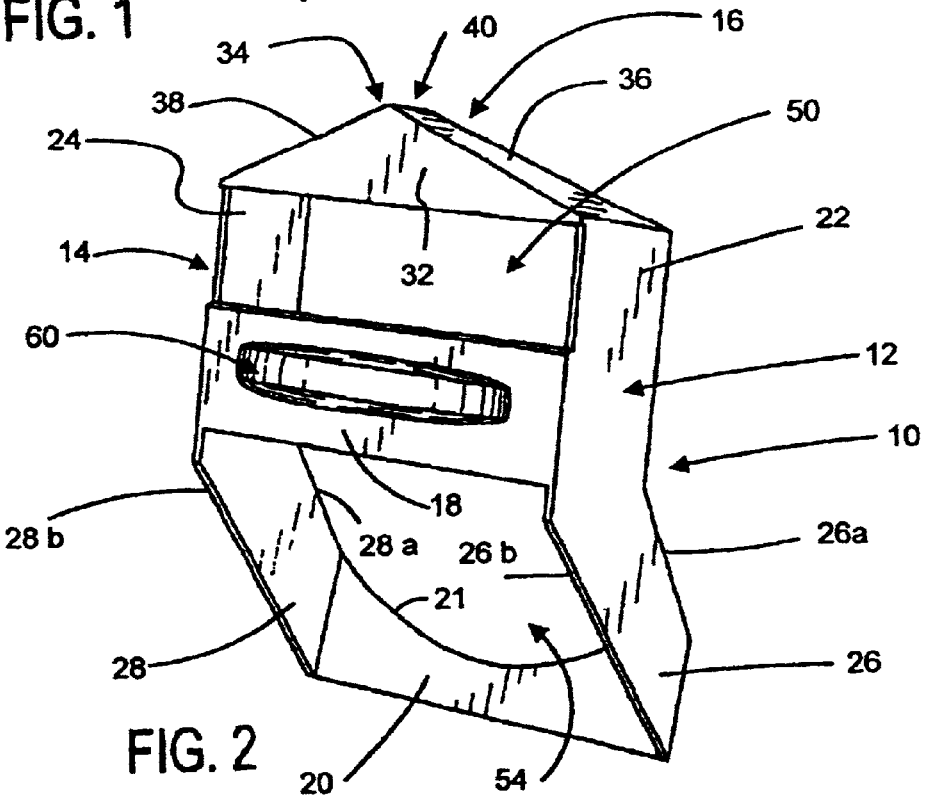
FIG. 2 is a front perspective view of the hair styling device.
Figure 3:
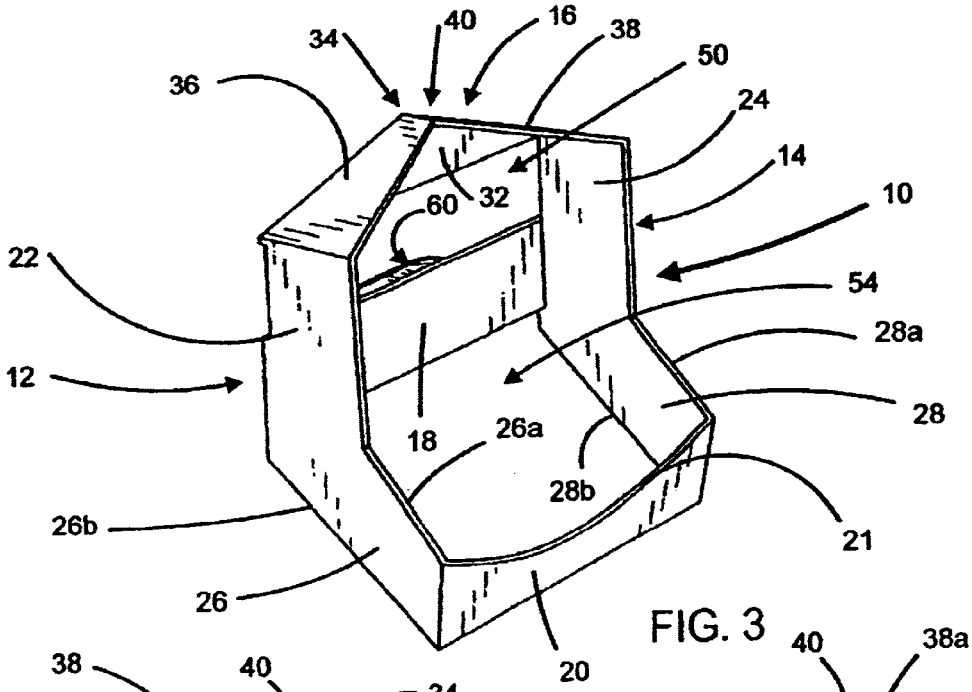
FIG. 3 is a rear perspective view of the hair styling device.
Figure 4:
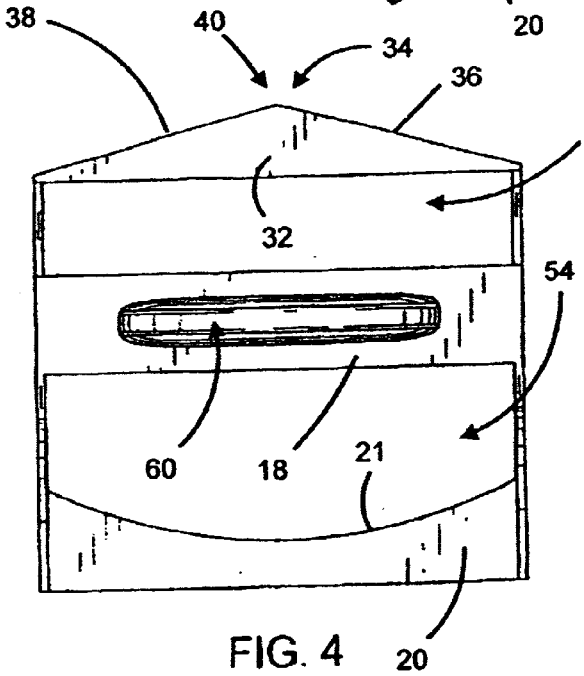
FIG. 4 is a front elevational view of the hair styling device.
Figures 6, 7, 8:
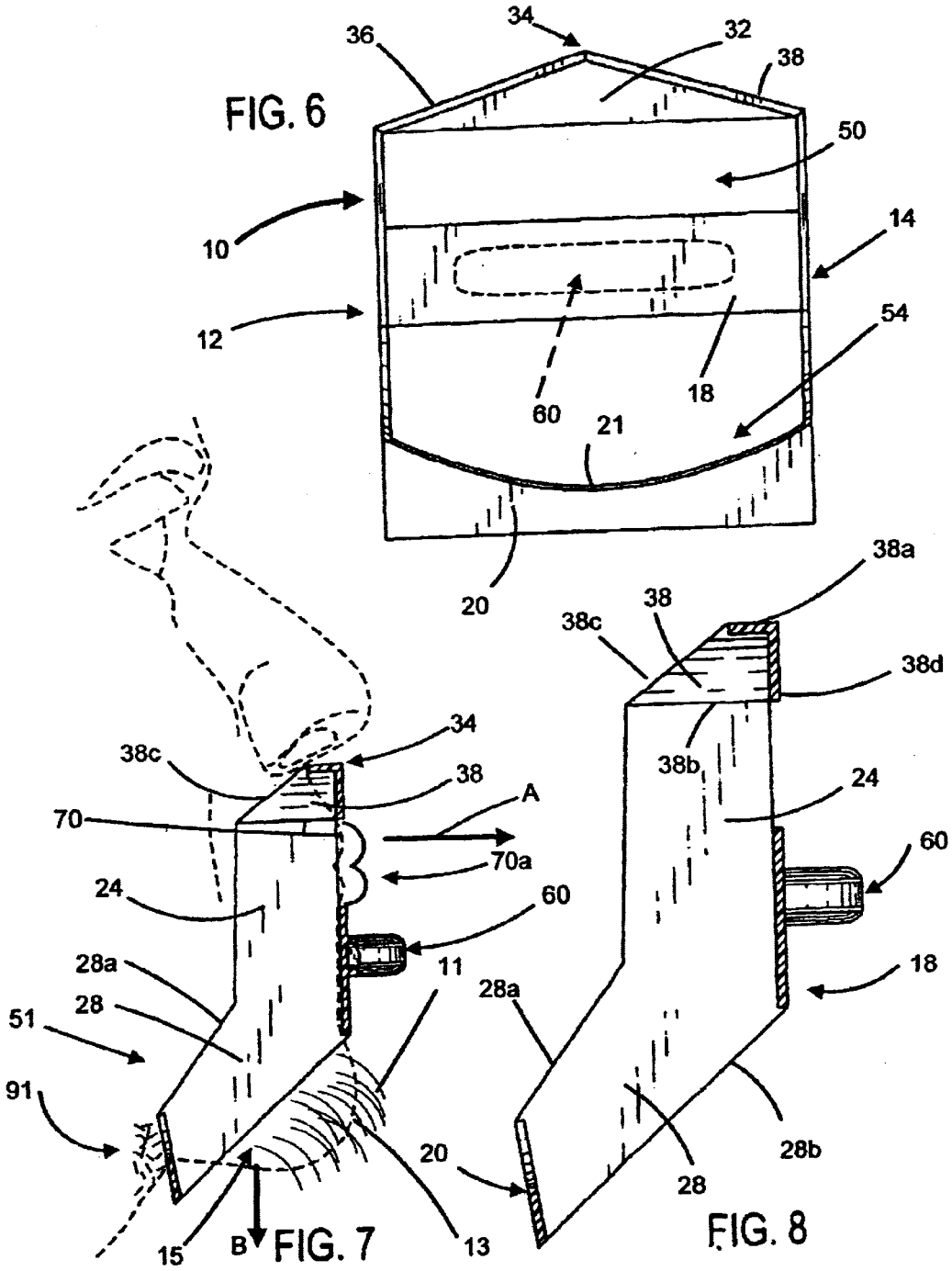
FIG. 6 is a rear elevational view of the hair styling device.
FIG. 7 is a vertical sectional view of the hair styling device when mounted on the lips and around a person's chin supporting a goatee.
FIG. 8 is another vertical sectional view of the hair styling device.

Referring in detail now to the drawings, wherein similar elements will be identified by like numerals, there is seen a device, generally illustrated as 10, for assisting in the trimming and styling of hair, especially hair or beard 91 growing in area 51 around and contiguous to hair 11 growing on a chin 13 to form a goatee 15, as best shown in FIG. 7. The device 10 includes a pair of sides 12 and 14, a top support member 16 connected or integrally bound to the sides 12 and 14, and an intermediate support member 18 spaced from the top support member 16 and attached to the sides 12 and 14. The device 10 also includes a bottom support member 20 suitably connected to the sides 12 and 14, as best shown in FIGS. 2 and 3, and having a concave or arcuate upper edge 21. The device 10 may be manufactured from any suitable material, such as plastic or metal. Area 51 is the area outside the sides 12 and 14 and the bottom support member 20. Thus, the width of the goatee is defined by the distance between sides 12 and 14. The boundaries of the goatee 15 are defined by an opening 54 whose boundaries or extremities are a portion of the sides 12, 14, the intermediate support member 18 and the bottom support member 20.

Figure 5:
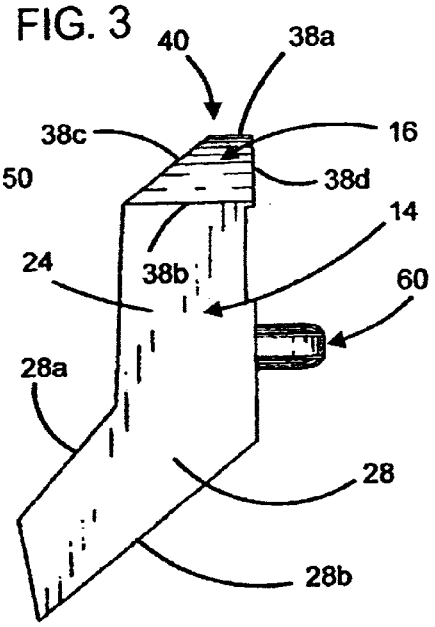
FIG. 5 is a side elevational view of the hair styling device.

Sides 12 and 14 are respectively defined by upper side sections 22 and 24 and lower side sections 26 and 28 integrally connected to upper side sections 22 and 24 and obliquely dependably extending away therefrom. Lower side sections 26 and 28 have top and bottom edges 26*a*, 26*b*, and 28*a*, 28*b*, respectively. As best shown in FIGS. 5 and 8, respectively, edges 26*a* and 26*b* and edges 28*a* and 28*b* taper towards each other until terminating in the bottom support member 20. Edges 26 and 26*b* terminate in extreme points of arcuate upper edge 21.

The top support member 16 is defined by a generally triangular gable or facade member 32 and a gable roof 34 formed by a pair of roof members 36 and 38 which terminate at apex 40 and in upper side sections 22 and 24, respectively. As best shown in FIGS. 5 and 8, roof members 36 and 38 downwardly slope and are generally trapezoidal in geometric shape, respectively including parallel edges 36*a*–36*b*, non-parallel edges 36*c*–36*d*, and parallel edges 38*a*–38*b*, nonparallel edges 38*c*–38*d*.

The intermediate support member 18 is generally rectangular in geometric shape and connects to sides 12 and 14, more specifically to upper side sections 22 and 24, such as to provide or form an opening 50 between the gable roof 34 and the intermediate support member 18. The intermediate support member 18 also connects to sides 12 and 14 in such a manner as to further provide or form the opening 54 between the bottom support member 20 and the intermediate support member 18. A handle or lug member 60 may be conveniently connected to the intermediate support member 18 to provide a structure for holding the device 10 in a desired position such that the area 51 around the goatee 15 may be trimmed.

Figure 1:
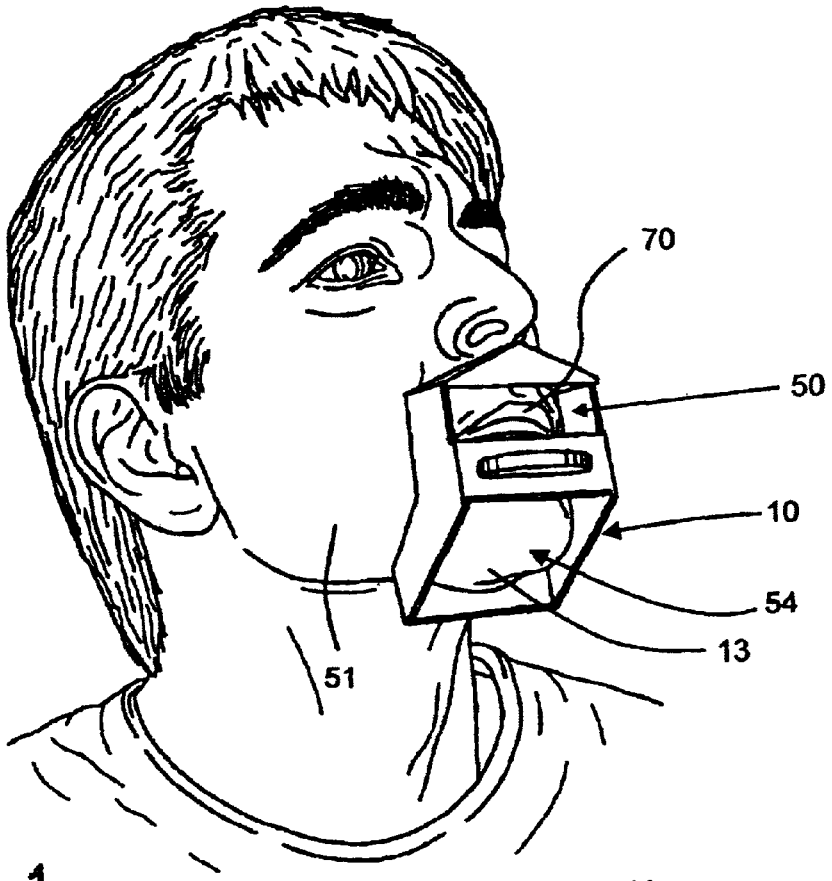
FIG. 1 is a perspective view of the hair styling device or guide positioned on the lips and around the chin of a person.

Continuing to refer to the drawings for operation and/or rise of the device 10, the chin 13 of a person is positioned within opening 54 and lips 70 are positioned within opening 50, as best shown in FIGS. 1 and 7. One of the features of the device 10 is that because of openings 50 and 54, the device 10 is capable of staying in position without having to use the ear lug 60. This is especially true if lips 70 are puckered in direction of arrow A of FIG. 7 to produce puckered lips 70*a* which extend through opening 50 farther than unpuckered lips 70. This is also especially true if the chin 13 is lowered downwardly in direction of arrow B and against upper edge 21 of the bottom support member 20, causing downward force or pressure by the gable roof 34 against the lips 70 or against puckered lips 70*a*. Thus, by lowering chin 13 and/or puckering lips 70 increases a frictional fit of the device 10 between lips 70 and the chin 13, particularly through outwardly expansion or divergence of the lips 70 and chin 13 away from each other. With the device 10 positioned as show in FIG. 7, the area 51 around the goatee 15 may be trimmed with a razor or the like, as desired.

While the present invention has been described herein with reference to particular embodiments thereof, a latitude of modification, various changes and substitutions are intended in the foregoing disclosure, and it will be appreciated that in some instances some features of the invention will be employed without a corresponding use of other features without departing from the scope and spirit of the invention as set forth. Therefore, many modifications may be made to adapt a particular situation or material to the teachings of the invention without departing from the essential scope and spirit of the present invention. It is intended that the invention not be limited to the particular embodiment disclosed as the best mode contemplated for carrying out this invention, but that the invention will include all embodiments and equivalents falling within the scope of the appended claims.

What is claimed is:

1. A device for styling hair comprising a pair of side walls, a top support member connected to the side walls, a bottom support member connected to the side walls, an intermediate support member connected to the side walls between the top support member and the bottom support member to form an upper opening between the top support member and the intermediate support member and a lower opening between the bottom support member and the intermediate support member, and a lug member secured to the intermediate support member, wherein said bottom support member includes a structure defining an arcuate edge.

2. The device of claim 1 wherein said top support member comprises a generally triangular gable member, and a gable roof secured to the gable member.

3. The device of claim 2 wherein said gable roof comprises a pair of generally trapezoidal shape roof members, each comprising a pair of non-parallel edges terminating in an apex.

4. The device of claim 3 wherein each of said side walls comprises an upper side section integrally connected to a lower side section obliquely extending away from said upper side section.

5. The device of Claim 4 wherein said lower side section comprises an upper side edge and a lower side edge tapering towards each other and terminating in the bottom support member.

6. The device of claim 5 wherein said upper side edge terminates in said arcuate edge of said bottom support member.

7. A device for styling hair comprising a pair of side walls, a top support member connected to the side walls, a bottom support member connected to the side walls, and an intermediate support member connected to the side walls between the top support member and the bottom support member to form an upper opening between the top support member and the intermediate support member and a lower opening between the bottom support member and the intermediate support member, wherein said top support member comprises a generally triangular gable member and a gable roof secured to the gable member.

8. The device of claim 7 wherein said gable roof comprises a pair of generally trapezoidal shape roof members, each comprising a pair of non-parallel edges terminating in an apex.

9. A device for styling hair comprising a pair of side walls, a top support member connected to the side walls, a bottom support member connected to the side walls, and an intermediate support member connected to the side walls between the top support member and the bottom support member to form an upper opening between the top support member and the intermediate support member and a lower opening between the bottom support member and the intermediate support member, wherein each of said side walls comprises an upper side section integrally connected to a lower side section obliquely extending away from said upper side section, and wherein said lower side section comprises an upper side edge and a lower side edge tapering towards each other and terminating in the bottom support member.

10. A method for styling a goatee comprising providing a device having an upper opening and a lower opening; positioning lips in the upper opening and a chin including a goatee in the lower opening; and trimming an area around the goatee such that opposed boundaries of the lower opening define a width for the goatee.

* * * * *